US007367473B2

(12) United States Patent
Meschiari

(10) Patent No.: US 7,367,473 B2
(45) Date of Patent: May 6, 2008

(54) CIRCUIT FOR DISPENSING FLUID PRODUCTS, IN PARTICULAR COLOURING AGENTS, PAINTS OR SIMILAR FLUID PRODUCTS

(75) Inventor: Maurizio Meschiari, Massa Finalese (IT)

(73) Assignee: CPS Color Equipment S.p.A, San Felice Sul Panaro (MO) (IT)

( * ) Notice: Subject to any disclaimer, the term of this patent is extended or adjusted under 35 U.S.C. 154(b) by 494 days.

(21) Appl. No.: 10/960,106

(22) Filed: Oct. 8, 2004

(65) Prior Publication Data

US 2006/0076360 A1 Apr. 13, 2006

(51) Int. Cl.
*B67D 5/08* (2006.01)

(52) U.S. Cl. ..... 222/63; 222/1; 222/71; 141/192; 137/625.65

(58) Field of Classification Search ..... 222/63, 222/71–73, 387, 1, 59; 141/198, 95, 26, 141/192, 94, 27, 18; 137/14, 334, 487.5, 137/15.19, 58, 115.26, 87.05, 87.06, 199, 137/624.12, 625.65, 625.3
See application file for complete search history.

(56) References Cited

U.S. PATENT DOCUMENTS 4,705,217 A * 11/1987 Hartley et al. ..... 239/142
4,808,092 A 2/1989 Funke
5,578,752 A 11/1996 Schlecht et al.
5,931,343 A * 8/1999 Topar et al. ..... 222/56
6,457,607 B1 10/2002 Andrea et al.
6,715,506 B1 * 4/2004 Ikushima ..... 137/14
6,814,110 B2 * 11/2004 Gardos ..... 141/198
6,962,270 B1 * 11/2005 Barker et al. ..... 222/129.4
7,111,757 B1 * 9/2006 O'Brien et al. ..... 222/71

FOREIGN PATENT DOCUMENTS

GB 2201948 * 9/1988 ..... 222/63
WO WO 91/08445 6/1991

* cited by examiner

*Primary Examiner*—Lien M. Ngo
(74) *Attorney, Agent, or Firm*—Sughrue Mion, PLLC

(57) ABSTRACT

A circuit for dispensing fluid products, in particular coloring agents, paints and the like, comprises a pump (12) for delivering a fluid product, which pump can be activated selectively to send the fluid product to a dispensing duct (16) and a valve (18) which is disposed on the dispensing duct (16) and which can be opened to dispense the fluid product. A control system (28) is able to control the activation of the pump (12) in order to dispense a predetermined quantity of the fluid product. A sensor (24) is provided to detect the opening of the valve (18) and thus the effective start of the dispensing operation to be signalled to the control system (28).

15 Claims, 4 Drawing Sheets

CIRCUIT FOR DISPENSING FLUID PRODUCTS, IN PARTICULAR COLOURING AGENTS, PAINTS OR SIMILAR FLUID PRODUCTS

FIELD OF THE INVENTION

The present invention relates to the field of circuits for dispensing fluid products.

The invention has been developed with particular regard to a circuit for dispensing fluid products, in particular colouring agents, paints or similar fluid products, which circuit comprises means for delivering at least one fluid product, which means can be activated selectively to send the at least one fluid product to at least one dispensing duct, valve means which are disposed on the at least one dispensing duct and which can be opened to dispense the at least one fluid product, and control means for bringing about the activation of the delivery means and dispensing a predetermined quantity of the at least one fluid product.

The invention relates also to a method for dispensing fluid products, in particular colouring agents, paints or similar fluid products, which method comprises the stage of providing a dispensing circuit comprising means for delivering at least one fluid product, which means can be activated selectively to send the at least one fluid product to at least one dispensing duct, and valve means which are disposed on the at least one dispensing duct and which can be opened to dispense the at least one fluid product, and the stage of activating the delivery means to send the at least one fluid product to the dispensing duct.

BACKGROUND OF THE INVENTION

A dispensing circuit of the type indicated above is known from U.S. Pat. No. 6,457,607 which describes a pumping unit comprising a stepper motor which operates a bellows pumping chamber for sending a fluid product to a dispensing duct along which a non-return valve is positioned. In order to dispense a desired quantity of fluid product, the stepper motor is operated for a determined number of steps which bring about a corresponding reduction in volume of the pumping chamber and therefore the delivery of a specific volume of fluid product.

The applicant has found that, under particular conditions of operation or for particular fluid products, the volume of fluid product delivered by the dispensing circuit may not correspond to the actual volume of fluid product desired. The applicant has found that sometimes the fluid product to be delivered, which is substantially incompressible per se, may incorporate a quantity of highly compressible air. During the operation of the above-mentioned circuit, therefore, the reduction in the volume of the pumping chamber caused by the operation of the motor is in part wasted in compressing the air inside the bellows and the dispensing duct, without a corresponding effective delivery of the fluid product. Consequently, the volume of fluid product actually delivered by the above-mentioned dispensing circuit may be smaller than that expected and desired on the basis of the operation of the motor.

The traditional solution to the problem indicated above is to calibrate the dispensing circuit in such a manner as to determine correcting values for the activation period or activation stroke of the motor, which are such as to compensate for the effect caused by the presence of air in the circuit and inside the incompressible fluid product to be delivered. It should, however, be noted that the quantity of air incorporated inside the incompressible fluid to be delivered is not constant over time and may vary within rather wide limits, to such an extent as to influence the precision and repeatability performance in the delivery operations of the above-mentioned known circuit. In particular, the applicant has found that often the quantity of air incorporated inside the colouring agent is at a maximum immediately after the reservoir of fluid product has been filled or topped up and tends to decrease with the passage of time. Unless the delivery circuit is calibrated continuously and repeatedly, it is extremely difficult, if not impossible, to obtain good precision and repeatability of delivery over time of the delivery circuit of the prior art.

Another solution, adopted in circuits of a more traditional design for dispensing colouring agents, consists in providing a controlled delivery valve, that is to say, a valve disposed on the dispensing duct, preferably disposed in the vicinity of the delivery nozzle for the fluid product, which opens on command for the time necessary to deliver the desired quantity thereof. Apart from the fact that the controlled or actuated valves of the above-mentioned type are expensive, require constant maintenance and normally have to provide a bypass with the possibility of re-circulating the fluid product to the reservoir when the valve is in the closed position, with a consequent complication of the dispensing circuit and the control thereof, it should be noted that the actual quantity of fluid product delivered is a function both of the opening time of the actuated valve and of the flow of fluid in the delivery duct. The value of this last parameter, unless suitable sensors are provided or special circuit configurations comprising pressure-limiting valves or the like are produced, is difficult to determine owing, again, to the presence of a non-specific quantity of air which is variable over time and which is incorporated in the incompressible fluid inside the dispensing circuit and, in particular, in the pumping unit and in the dispensing duct upstream of the controlled valve.

U.S. Pat. No. 5,578,752 discloses a process and device for determining the flow rate of a substance conveyed by means of a thick matter piston pump through a delivery pipe. The feeding pressure in the delivery pipe is measured at predetermined time intervals by means of a pressure sensor. The interval between successive pressure strokes, used to determined the number of frequency of strokes, as well as the filling level of the delivery cylinder, used to determine the actual delivery volume per pressure stroke, are both derived from the time-dependent amplitude characteristic of the measured delivery pressure.

U.S. Pat. No. 4,808,092 discloses a precision dosing pump intended especially for use in High Performance Liquid Chromatography (HPLC) technology, wherein the pump-head housing, the pump-head bush and the cartridge-like valve units are made of a transparent material. The movement of the balls in the valve units can be detected by means of an optical sensor system in order to obtain a control signal for a control circuit for compensating the effect of the specific compressibility of the delivery medium.

International patent application WO-A-91/08445 discloses a flowmetering apparatus wherein the flow of a multi-phase fluid and of the gas and liquid fractions it contains is measured in a piston pump by sensing the position of a fluid compressive piston as by a pressure transducer or by sensing opening of a discharge valve opening at a known pressure.

SUMMARY OF THE INVENTION

One object of the present invention is to overcome the problems of the prior art and to provide a circuit and a method for dispensing fluid products in which the quantity, and in particular the volume, of fluid products actually dispensed coincides substantially with the nominal quantity desired and required by the user.

Another object of the present invention is to provide a circuit and a method for carrying out a dispensing operation with a high degree of repeatability, that is to say, in which the above-mentioned correspondence between the quantity of fluid products actually delivered and the desired nominal quantity is constant over time without the necessity for frequent calibrations of the circuit.

A further object of the present invention is to provide a dispensing circuit and method which are simple and economical, safe, reliable, easy to use and which do not provide for complex or expensive maintenance operations.

In order to achieve the objects indicated above, the invention relates to a dispensing circuit of the type indicated in the preamble of the present description, comprising sensor means for detecting the opening of the valve means and thus signalling to the control means the effective start of the dispensing operation.

The invention relates also to a dispensing method of the type indicated in the preamble of the present description, comprising the stages of signalling the opening of the valve means and actuating the dispensing of the at least one fluid product from the signalling of the opening of the valve means.

Preferably, although this is not to constitute a limitation, the sensor means are in communication with the control means, for example, by way of a wired connection, such as an electrical conductor, an optical fibre or the like, or with a system without wires, for example via radio, an infrared ray system or other similar means, in order to transmit to the control means a signal indicating the opening and/or the closing of the valve means.

An important advantage of the present invention is that the control system can use as a reference for the dispensing of the desired quantity of fluid product the effective start of the dispensing operation, of which it is informed by means of the signals gathered by the sensor means, and which thus coincides with the opening of the valve means, irrespective of when the delivery means were activated, in particular the control motor of the pumping unit.

The opening of the valve means and the consequent signal indicating the start of the dispensing operation are independent of any other control means and result purely from the attainment of conditions fixed beforehand, for example the pressure differential in the dispensing duct upstream and downstream, respectively, of the valve means. This makes it possible to use a simple non-controlled non-return valve as the valve means.

Among other things, the fact that the determination and signalling of the effective start of the delivery of fluid product take place independently of the control system used enables the present invention to be adopted also in circuits provided with controlled valves, because the lack of a signal confirming that the valve has opened as a consequence of a controlled opening actuation thereof can warn of a possible obstruction or leakage in the dispensing duct which prevents the attainment of the pre-set delivery conditions in the vicinity of the valve. This information can be used in various manners, for example, to activate an error sequence or to interrupt the operation of the circuit.

Of course, a malfunction warning function similar to that indicated above with reference to controlled valves may be adopted also in the case of circuits having non-controlled valves, for example, the simple non-return valves used in the case of the preferred embodiment of the present invention.

The shutter of the valve means may advantageously incorporate or itself be the means of signalling its own position or its own opening and/or closing movement. It is particularly advantageous to incorporate in the shutter or to produce the entire shutter with a material which interacts with a sensor placed outside the valve body in order to generate a variable electromagnetic field and a consequent electrical signal indicating the position and/or the movement of the shutter. For that purpose it is possible to use the typical characteristics of Hall-effect sensors, or of magnetostrictive materials or the like, which can all be adapted to implement the present invention.

According to a preferred embodiment of the present invention, the delivery means comprise an electrical motor which is preferably, although this is not to constitute a limitation, a stepper motor, for example, for moving the movable wall of a variable-volume pumping chamber by means of a linear actuator of the type having an internally and externally threaded member. When the motor has initially been started, the control system causes the stepper motor to move by the number of steps necessary to dispense the predetermined quantity, starting to count them from the reference instant coinciding with the moment at which the valve means are opened.

According to the preferred embodiment, the valve means are along the dispensing duct, preferably, although this is not to constitute a limitation, in the vicinity of or at the location of a delivery nozzle. A high degree of dispensing precision and repeatability is thus achieved because the transient state during which the air in the delivery circuit is compressed without fluid product being dispensed also takes into account the quantity of fluid product contained in the delivery duct, downstream of the pumping means but upstream of the valve means. If the structural details of the machine for dispensing fluid products include long delivery ducts, the difference in performance compared with known machines may be substantial.

BRIEF DESCRIPTION OF THE DRAWING

Further features and advantages will emerge from the following description of a preferred embodiment, with reference to the appended drawing which is given purely by way of non-limiting example and in which.

DESCRIPTION OF A PREFERRED EMBODIMENT

Figure 1:
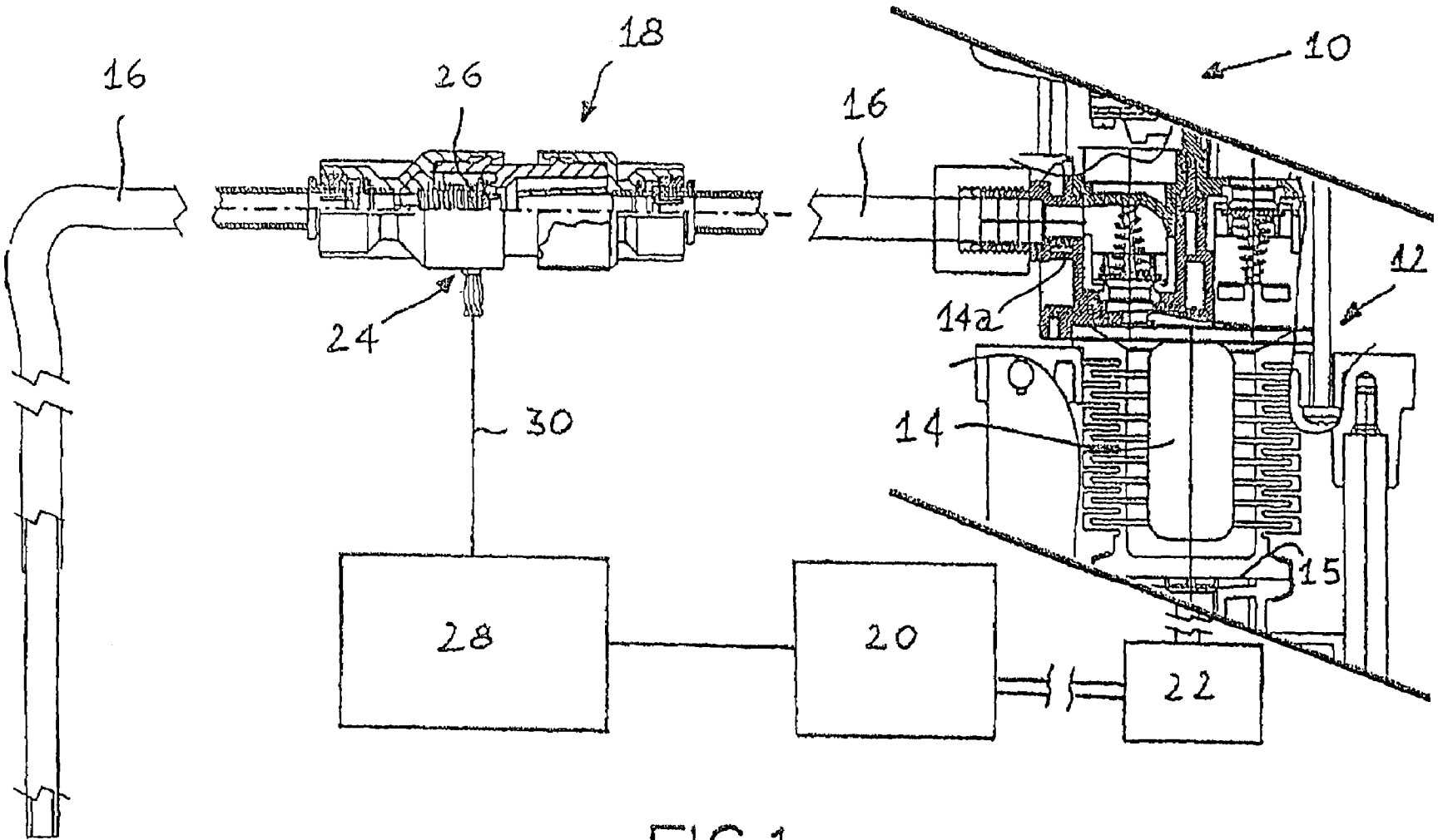
FIG. 1 is a partly sectioned side view of a dispensing circuit according to the present invention, in which for the sake of simplicity some components have been represented schematically and a pump for fluid products is in partial view.

Referring to FIG. 1, a dispensing circuit 10 for fluid products according to the present invention comprises pump means, for example, a pump 12 of the type having a variable-volume pumping chamber 14 with at least one movable wall 15, such as a bellows or piston chamber.

A dispensing duct 16 is connected to the exit duct 14*a* of the pumping chamber 14 and a non-return valve 18 is mounted along the dispensing duct 16. Alternatively, the non-return valve 18 may also be mounted in the pump 12.

Motor means 20, such as, for example, a hydraulic or pneumatic piston, or an electrical motor, preferably of the stepper type, although this is not to constitute a limitation, are connected to the movable wall 15 by way of moving means 22, such as, for example, a device having an internally and externally threaded member.

The non-return valve 18 comprises a shutter 26 and a sensor 24 is mounted on the non-return valve 18 at the location of the shutter 26 in order to detect the opening movement thereof.

A control system 28 for the motor means 20 is connected to the sensor 24 in order to receive therefrom a signal by way of a connection 30, such as an electrical cable or an infrared ray connection.

Figure 2:
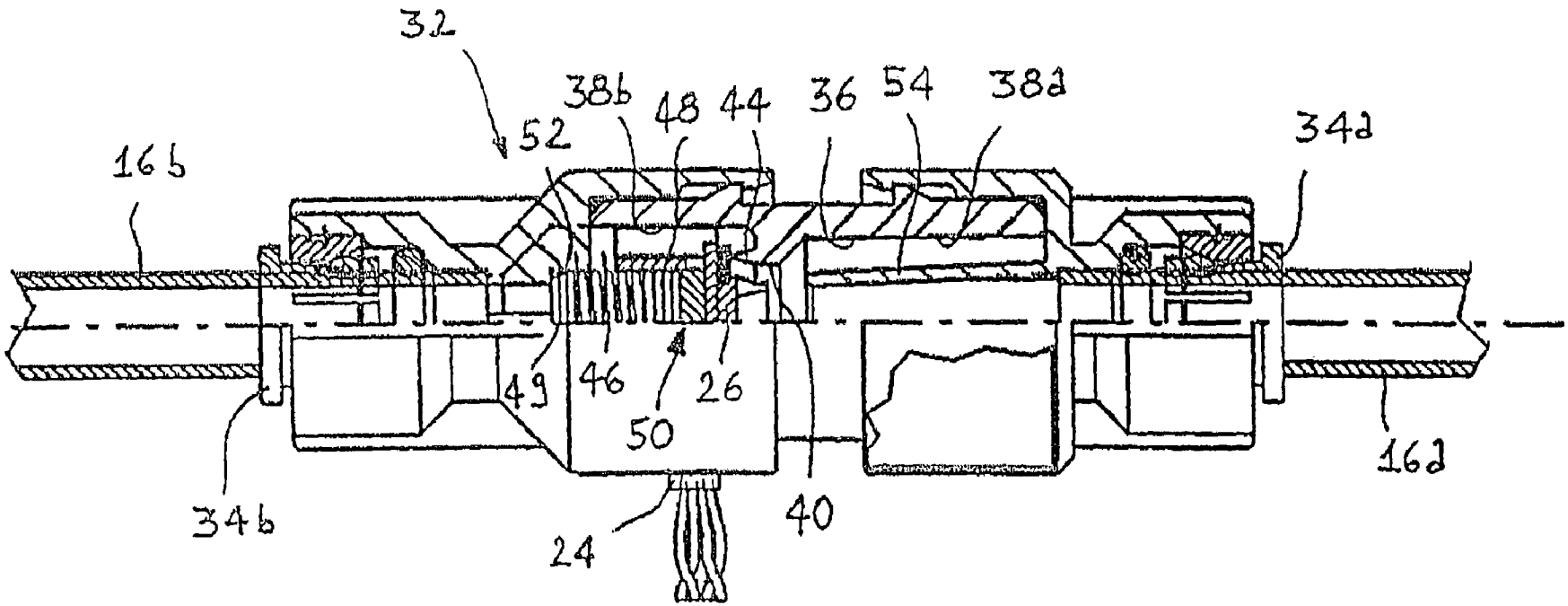
FIG. 2 is a partly sectioned side view of a non-return valve having a sensor according to the present invention.
Figure 3:
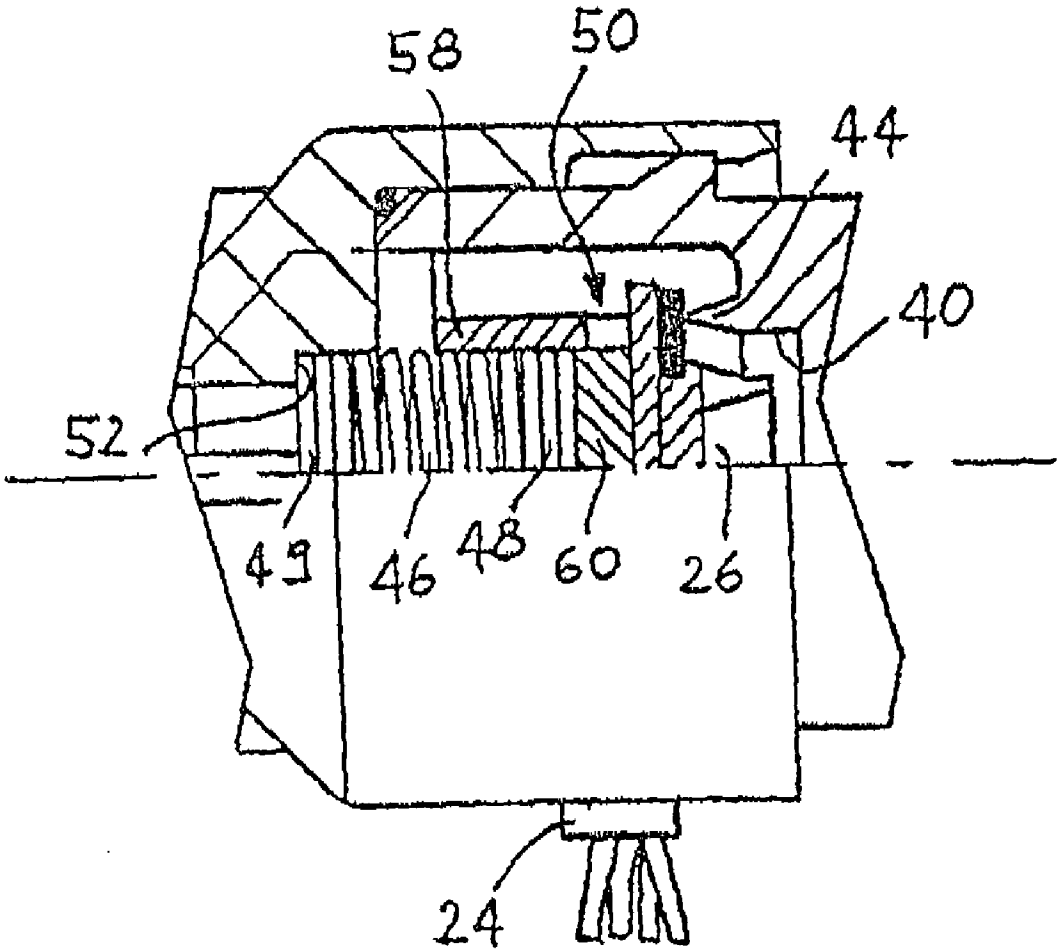
FIG. 3 is a partly sectioned side view on an enlarged scale of a portion of the valve of FIG. 2.

Referring now to FIGS. 2 and 3, the non-return valve 18 further comprises a main body 32 having an inlet mouth 34*a* and an outlet mouth 34*b* inside which a first portion 16*a* and a second portion 16*b*, respectively, of the dispensing duct 16 are inserted. The inlet and outlet mouths 34*a* and 34*b* are in communication therebetween via a cavity 36 inside the main body 32.

The cavity 36 is subdivided into an inlet portion 38*a* and an outlet portion 38*b* which communicate by way of an internal mouth 40, which is, for example, in the form of a narrowing of the cavity 36. Inserted in the outlet portion 38*b* is the afore-mentioned shutter 26 which, in the resting position, closes the internal mouth 40, coming into abutment with a cutting rim 44 which surrounds the entire circumference of that mouth.

The shutter 26 is movable from the closing position, in which it abuts the cutting rim 44, to an opening position in which it is moved back relative to the internal mouth 40 inside the outlet portion of the cavity 36. The thrust necessary to keep the shutter in the position closing the non-return valve 18 is provided, for example, by resilient means, such as a helical spring 46 coupled at one end 48 thereof to the back 50 of the shutter 26 and at the opposite end 49 to a shoulder 52 facing the internal mouth 40 and formed in the outlet portion 38*b*.

The inlet and outlet mouths 34*a* and 34*b*, the cavity 36, the internal mouth 40, the shutter 26, the cutting rim 44 and the shoulder 52 are preferably coaxial with one another, although this is not to constitute a limitation.

A filter 54 is preferably interposed between the inlet mouth 34*a* and the inlet portion 38*a* of the cavity 36 in order to prevent the impurities present in the fluid products in question from coagulating in the regions of abutment between the shutter 26 and the cutting rim 44, which impurities could hinder the complete closure of the non-return valve 18.

A cylindrical housing 58 is disposed in the outlet portion 38*b* for lodging a signal emitter 60 which is connected to the back 50 of the shutter 26 and is axially movable therewith. For example, the signal emitter 60 may be a source of electromagnetic field, such as an electrical winding, or a small piece of magnetic material which is able to emit a magnetic field which varies with the movement of the shutter 26.

The sensor 24 is mounted on a portion of the main body 32 in correspondence to the shutter 26 and is able to detect the signal emitted by the signal emitter 60, or alternatively the variation in that signal, such as the variation of an electromagnetic field.

As an alternative to the signal emitter 60 and the sensor 24, it is possible to use any detection system for detecting the start of the movement of the fluid products to be dispensed at the location of the non-return valve 18, for example, a sensor for detecting the movement directly, such as a probe for measuring the velocity or acceleration of fluid products, or a system of indirect detection, such as a Venturi meter and pressure probes for detecting a difference in pressure.

As a further alternative, it is possible to use a system for detecting the opening of the non-return valve 18 which preferably detects the movement of the shutter 26, using any physical, chemical, electrical, magnetic or electromagnetic principle associated with the said movement. An example which may be mentioned is the possibility of associating the movement of the shutter 26 with the variation in an electrical quantity, for example using a conventional sliding contact on a resistor, or by means of the use of a magnetostrictive material, which is compressed or expanded by the shutter 26 as it opens in such a manner as to modify the conductivity characteristics thereof.

According to one possible variant, the non-return valve 18 may be replaced by a controlled valve, in which case the system for detecting the opening of the valve acts as a system for confirming opening, and may also be either of the direct type, that is to say, detecting the movement of the shutter 26, or of the indirect type, detecting the movement of the fluid products.

In use, the circuit of the present invention remains under static conditions until the moment at which it is necessary to dispense a quantity of product.

Figure 4:
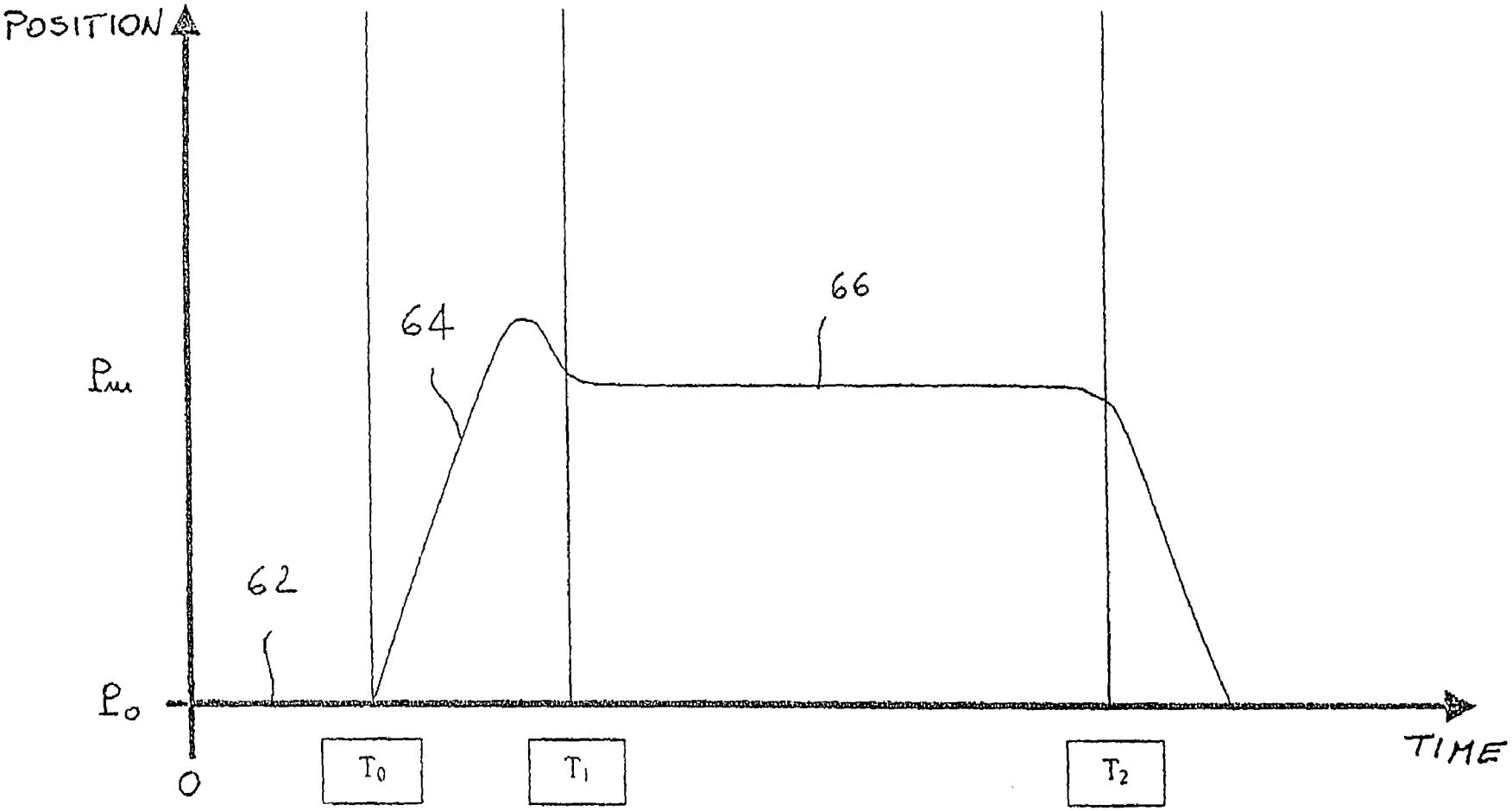
FIG. 4 is a graph showing the progression of the position as a function of time of the shutter of the valve of FIG. 2 in the circuit of FIG. 1 during the stages of a dispensing method according to the present invention.

In the graph of FIG. 4, this stage is indicated by the sector 62 in which from instant 0 (zero) up to the moment $T_0$ the pressure remains approximately constantly around an initial value, which is insufficient to move the shutter 26 which is in an initial position $P_0$. Let us suppose, by way of example, which is in no way to be regarded as limiting, that, under those conditions, the movable wall 15 is in a position which we shall call lowered, meaning a position in which the variable-volume chamber 14 has a larger volume than its minimum volume and contains the fluid product to be dispensed. Subsequently, the motor mans 20 are operated by the control system 28 or by the direct intervention of an operator and, by acting on the moving means 22, start to move the movable wall 15 towards a position which we shall call raised, meaning a position in which the variable-volume chamber 14 has a volume smaller than that corresponding to the lowered position. During this movement of the movable wall 15 from the lowered position to the raised position, the fluid product contained in the variable-volume chamber 14 and in the dispensing duct as far as the non-return valve 18 is compressed because of the presence of air in suspension and the resistance offered by the circuit to the movement of the product; the curved line 64 illustrates this compression.

The fluid product completes the initial compression stage when it starts to move in the duct portion in the vicinity of the non-return valve 18. When this circumstance occurs, it means that a pressure has been reached which is sufficient to overcome the resistance to movement which also includes resistance to the opening of the shutter 26 which moves into a position of maximum opening Pm of the non-return valve 18. The movement of the fluid product through the non-return valve 18, or alternatively the position of the shutter, is detected by the sensor 24 which transmits a corresponding signal to the control system 28 which in turn considers the instant at which movement starts to be the instant from which to start to bring about the dispensing of the required quantity of product by operating the motor means.

The control system 28 may, for example, bring about the operation of the motor means from instant $T_1$ at which it receives the signal from the sensor 24 for a dispensing period $T_2$-$T_1$ corresponding to stage 66 of FIG. 4 in which the pressure remains approximately equal to the pressure of movement $P_m$, after which, at instant $T_2$, it causes the dispensing operation to be interrupted by causing the motor means to stop.

Alternatively, in the embodiment with a stepper motor 20, the control system 28 can cause the stepper motor 20 to advance by a number of steps corresponding to the desired quantity of product from instant $T_1$ at which it receives from the sensor 24 the signal corresponding to the movement of the fluid product or to the position of maximum opening $P_m$ of the shutter 26.

One of the advantages of the present invention is that the quantity of product dispensed is determined by the control system by causing the motor means to move by the necessary amount at the end of an initial transient state in which the movement of the motor means does not correspond to a dispensing of the fluid products but only to a compression which brings the fluid products to the pressure necessary to overcome the resistance to movement in the circuit. With the present invention, the quantity of product dispensed corresponds to that theoretically required because the transient state of compression is not regarded as an actual dispensing period.

A further advantage of the present invention is that the circuit does not have to be calibrated each time there is a change in the compressibility of the fluid product in question, for example, for the different quantity of air in suspension in the same fluid product before and after a period of decanting into a reservoir supplying the circuit, given that the end of the transient state of compression and the start of the dispensing operation always coincide with the opening of the non-return valve 18.

Another advantage of the present invention is that it includes a control system having very simple feedback, given that there is no need to control the valves but only to signal their opening as a reference for starting to count the quantity of product to be dispensed, which is effectively delivered by controlling only the motor means on the basis of that reference. For the reasons given above, the dispensing circuit of the present invention is very economical.

Naturally, the principle of the invention remaining the same, the structural characteristics and the details of production may be varied widely with respect to those described and illustrated without thereby departing from the scope of the present invention.

The invention claimed is:

1. A circuit for dispensing fluid products, in particular colouring agents, paints or similar fluid products, comprising:

delivery means having an exit for delivering at least one fluid product;

a dispensing duct connected to said exit of said delivery means;

motor means connected to said delivery means and able to be activated for selectively actuating said delivery means to send at least said fluid product to said dispensing duct;

valve means disposed on said dispensing duct and able to be opened to dispense said fluid product;

control means for starting the activation of said motor means to start the delivery of said fluid product to said dispensing duct;

sensor means for detecting the effective opening movement of said valve means and thus generating a corresponding starting signal, wherein said control means are able to receive said starting signal and to maintain said motor means activated for a predetermined period of time beginning on the generation of said starting signal for causing the actual dispensing of a predetermined quantity of said fluid product from said valve means.

2. A dispensing circuit according to claim 1, wherein said valve means comprises a shutter movable from a close position wherein said dispensing duct is closed, to an open position wherein said dispensing duct is open, and wherein said shutter automatically moves from one to another position in dependence on the difference in pressure upstream and downstream thereof.

3. A dispensing circuit according to claim 2, wherein said shutter comprises emitting means able to emit a reference signal able to be detected by said sensor means.

4. A dispensing circuit according to claim 3, wherein said reference signal comprises a variation dependent, on the movement of said shutter.

5. A dispensing circuit according to claim 3, wherein said reference signal comprises a variation in an electromagnetic field.

6. A dispensing circuit according to claim 1, wherein said delivery means comprise a variable-volume pumping chamber having at least one movable wall.

7. A dispensing circuit according to claim 6, wherein said motor means comprise an electrical motor activated by said control means to move said movable wall of said pumping chamber.

8. A dispensing circuit according to claim 7, wherein said electrical motor is a stepper motor.

9. A method for dispensing fluid products, in particular colouring agents, paints and similar fluid products, comprising:

providing a dispensing circuit comprising delivery means having an exit for delivering at least one fluid product, a dispensing duct connected to said exit of said delivery means, motor means connected to said delivery means for selectively actuating said delivery means, and valve means disposed on said dispensing duct and able to be opened to dispense said fluid product, wherein said motor means are able to be selectively activated to cause said delivery means to send said fluid product to said dispensing duct;

starting the activation of said motor means to start the delivery of said fluid product to said dispensing duct;

detecting the effective opening movement of said valve means and thus generating a corresponding starting signal; and maintaining said motor means activated for a predetermined period of time beginning on the generation of said starting signal for causing the actual dispensing of a predetermined quantity of said fluid product from said valve means.

10. A dispensing method according to claim 9, further comprising:

providing control means for controlling said motor means;

providing sensor means for detecting the opening of said valve means and generating said starting signal;

sending said starting signal to said control means for determining the counting of said predetermined period of time.

11. A dispensing method according to claim 10, wherein said valve means comprises a shutter movable from a close position wherein said dispensing duct is closed, to an open position wherein said dispensing duct is open, and wherein said shutter automatically moves from one to another position in dependence on the difference in pressure upstream and downstream thereof.

12. A dispensing method according to claim 11, wherein said sensor means are able to detect any movement of said shutter.

13. A dispensing method according to claim 11, wherein said shutter is able to emit a movement signal indicative of the movement thereof, and wherein said sensor means are able to detect said movement signal to generate said starting signal.

14. A dispensing method according to claim 10, wherein said delivery means comprise pump means actuated by said motor means.

15. A dispensing method according to claim 9, wherein said motor means comprise a stepper motor and wherein said stepper motor is activated for a predetermined number of steps in order to cause the actual delivery of said predetermined quantity of said fluid product starting from the generation of said starting signal.

* * * * *